US008416197B2

(12) United States Patent
Feng et al.

(10) Patent No.: US 8,416,197 B2
(45) Date of Patent: Apr. 9, 2013

(54) PEN TRACKING AND LOW LATENCY DISPLAY UPDATES ON ELECTRONIC PAPER DISPLAYS

(75) Inventors: Guotong Feng, Mountain View, CA (US); John W. Barrus, Menlo Park, CA (US)

(73) Assignee: Ricoh Co., Ltd, Tokyo (JP)

( * ) Notice: Subject to any disclaimer, the term of this patent is extended or adjusted under 35 U.S.C. 154(b) by 1039 days.

(21) Appl. No.: 12/059,091

(22) Filed: Mar. 31, 2008

(65) Prior Publication Data

US 2008/0309636 A1 Dec. 18, 2008

Related U.S. Application Data

(60) Provisional application No. 60/944,415, filed on Jun. 15, 2007.

(51) Int. Cl.
*G06F 3/041* (2006.01)

(52) U.S. Cl. ..... 345/173; 345/178

(58) Field of Classification Search ..... 345/5–25, 345/87, 89, 105–108, 156, 169–182, 204–214, 345/626, 520, 419, 660, 690, 501, 536, 55, 345/545, 59; 455/556.1; 178/18.01–18.09, 178/19.01–19.05; 349/62
See application file for complete search history.

(56) References Cited

U.S. PATENT DOCUMENTS 4,065,770 A 12/1977 Berry
4,367,465 A * 1/1983 Mati et al. ..... 345/180
4,930,875 A 6/1990 Inoue et al.
5,029,257 A 7/1991 Kim
5,122,791 A 6/1992 Gibbons
5,509,085 A 4/1996 Kakutani
5,605,406 A * 2/1997 Bowen ..... 400/472
5,608,420 A 3/1997 Okada
5,703,621 A * 12/1997 Martin et al. ..... 345/690
(Continued)

FOREIGN PATENT DOCUMENTS

CN 1519620 8/2004
CN 1577471 2/2005
(Continued)

OTHER PUBLICATIONS

J.E. Bresehham, *Algorithm for computer control of a digital plotter*, IBM Systems Journal, 1965, pp. 25-30, vol. 4, No. 1.

(Continued)

*Primary Examiner* — Prabodh M Dharia
(74) *Attorney, Agent, or Firm* — Patent Law Works LLP

(57) ABSTRACT

A system and a method are disclosed for fast pen tracking a low latency display updates on an electronic paper display. Pen input information is received on an electronic paper display that updates at a predetermined display update rate. A line drawing module of the electronic paper display driver determines at least one pixel to activate based on the received pen input information. The at least one pixel is updated independent of the display update rate of the electronic paper display. Active pixel state information is maintained separately for each pixel in real time until the pixel update is complete and the pixel is deactivated. In some embodiments, a future pixel to activate is determined based on the received pen input information. The future pixel is deactivated if pen input information is not received on the activated pixel for a predetermined amount of time.

24 Claims, 7 Drawing Sheets

U.S. PATENT DOCUMENTS

| | | | | |
|---|---|---|---|---|
| 5,754,156 | A | 5/1998 | Erhart et al. | |
| 5,815,134 | A | 9/1998 | Nishi | |
| 5,963,714 | A | 10/1999 | Bhattacharjya et al. | |
| 6,067,185 | A | 5/2000 | Albert et al. | |
| 6,147,671 | A | 11/2000 | Agarwal | |
| 6,191,771 | B1 | 2/2001 | Kondoh | |
| 6,243,063 | B1 | 6/2001 | Mayhew et al. | |
| 6,285,774 | B1 * | 9/2001 | Schumann et al. | 382/100 |
| 6,327,017 | B2 | 12/2001 | Barberi et al. | |
| 6,377,249 | B1 * | 4/2002 | Mumford | 345/179 |
| 6,504,524 | B1 | 1/2003 | Gates et al. | |
| 6,563,957 | B1 * | 5/2003 | Li et al. | 382/252 |
| 6,707,516 | B1 * | 3/2004 | Johnson et al. | 349/78 |
| 6,721,458 | B1 | 4/2004 | Ancin | |
| 6,738,039 | B2 | 5/2004 | Goden | |
| 6,791,716 | B1 | 9/2004 | Buhr et al. | |
| 6,804,191 | B2 | 10/2004 | Richardson | |
| 6,809,724 | B1 * | 10/2004 | Shiraishi et al. | 345/169 |
| 6,850,217 | B2 | 2/2005 | Huang et al. | |
| 6,864,875 | B2 * | 3/2005 | Drzaic et al. | 345/107 |
| 6,901,164 | B2 | 5/2005 | Sheffer | |
| 6,924,442 | B2 * | 8/2005 | Nakano et al. | 178/19.01 |
| 7,012,600 | B2 | 3/2006 | Zehner et al. | |
| 7,034,814 | B2 * | 4/2006 | Gong et al. | 345/211 |
| 7,075,502 | B1 * | 7/2006 | Drzaic et al. | 345/55 |
| 7,109,967 | B2 * | 9/2006 | Hioki et al. | 345/104 |
| 7,119,772 | B2 | 10/2006 | Amundson et al. | |
| 7,154,452 | B2 * | 12/2006 | Nakamura et al. | 345/1.1 |
| 7,200,242 | B2 | 4/2007 | Murakami | |
| 7,227,519 | B1 | 6/2007 | Kawase et al. | |
| 7,280,103 | B2 | 10/2007 | Taoka et al. | |
| 7,372,594 | B1 | 5/2008 | Kusakabe et al. | |
| 7,429,706 | B2 * | 9/2008 | Ho | 178/18.01 |
| 7,456,808 | B1 | 11/2008 | Wedding et al. | |
| 7,483,018 | B2 * | 1/2009 | Oliver | 345/179 |
| 7,528,848 | B2 * | 5/2009 | Xu et al. | 345/626 |
| 7,733,311 | B2 | 6/2010 | Amundson et al. | |
| 7,804,483 | B2 | 9/2010 | Zhou et al. | |
| 7,839,381 | B2 | 11/2010 | Zhou et al. | |
| 8,041,291 | B2 * | 10/2011 | Hullot et al. | 455/3.01 |
| 2002/0036616 | A1 | 3/2002 | Inoue | |
| 2002/0056805 | A1 | 5/2002 | Bos et al. | |
| 2002/0074171 | A1 * | 6/2002 | Nakano et al. | 178/18.01 |
| 2003/0011579 | A1 * | 1/2003 | Gong et al. | 345/204 |
| 2003/0020701 | A1 * | 1/2003 | Nakamura et al. | 345/204 |
| 2003/0063575 | A1 | 4/2003 | Kinjo | |
| 2003/0095094 | A1 | 5/2003 | Goden | |
| 2003/0137521 | A1 | 7/2003 | Zehner | |
| 2003/0227441 | A1 * | 12/2003 | Hioki et al. | 345/156 |
| 2004/0002023 | A1 | 1/2004 | Sowinski | |
| 2004/0028256 | A1 | 2/2004 | Murakami | |
| 2004/0165115 | A9 | 8/2004 | Daly | |
| 2005/0013501 | A1 | 1/2005 | Kang et al. | |
| 2005/0116924 | A1 * | 6/2005 | Sauvante et al. | 345/108 |
| 2005/0174591 | A1 | 8/2005 | Sowinski et al. | |
| 2005/0179642 | A1 | 8/2005 | Wilcox et al. | |
| 2005/0212747 | A1 | 9/2005 | Amundson | |
| 2005/0219184 | A1 | 10/2005 | Zehner et al. | |
| 2005/0248575 | A1 | 11/2005 | Chou et al. | |
| 2005/0280626 | A1 | 12/2005 | Amundson et al. | |
| 2005/0281334 | A1 | 12/2005 | Walker et al. | |
| 2006/0055713 | A1 | 3/2006 | Asao et al. | |
| 2006/0066503 | A1 | 3/2006 | Sampsell et al. | |
| 2006/0066595 | A1 | 3/2006 | Sampsell et al. | |
| 2006/0112382 | A1 | 5/2006 | Glass et al. | |
| 2006/0164405 | A1 | 7/2006 | Zhou | |
| 2006/0169980 | A1 | 8/2006 | Morita et al. | |
| 2006/0170648 | A1 | 8/2006 | Zhou et al. | |
| 2007/0002009 | A1 * | 1/2007 | Pasch et al. | 345/108 |
| 2007/0013627 | A1 | 1/2007 | Hsieh et al. | |
| 2007/0035510 | A1 | 2/2007 | Zhou | |
| 2007/0052667 | A1 | 3/2007 | Zhou et al. | |
| 2007/0057905 | A1 | 3/2007 | Johnson et al. | |
| 2007/0057906 | A1 | 3/2007 | Johnson et al. | |
| 2007/0075949 | A1 | 4/2007 | Lu et al. | |
| 2007/0085819 | A1 | 4/2007 | Zhou et al. | |
| 2007/0087756 | A1 | 4/2007 | Hoffberg | |
| 2007/0139399 | A1 * | 6/2007 | Cook | 345/179 |
| 2007/0140351 | A1 * | 6/2007 | Ho | 375/240.24 |
| 2007/0176912 | A1 | 8/2007 | Beames et al. | |
| 2007/0205978 | A1 | 9/2007 | Zhou et al. | |
| 2007/0206262 | A1 | 9/2007 | Zhou | |
| 2007/0268285 | A1 * | 11/2007 | Bursett | 345/211 |
| 2008/0068291 | A1 | 3/2008 | Yuan et al. | |
| 2008/0084600 | A1 | 4/2008 | Bita et al. | |
| 2008/0111778 | A1 | 5/2008 | Shen et al. | |
| 2008/0135412 | A1 * | 6/2008 | Cortenraad et al. | 204/554 |
| 2008/0143691 | A1 * | 6/2008 | Cook | 345/179 |
| 2008/0198098 | A1 * | 8/2008 | Gelbman et al. | 345/59 |
| 2008/0243344 | A1 * | 10/2008 | Casey et al. | 701/50 |
| 2008/0309636 | A1 * | 12/2008 | Feng et al. | 345/173 |
| 2008/0309657 | A1 * | 12/2008 | Rhodes et al. | 345/214 |
| 2008/0309674 | A1 * | 12/2008 | Barrus et al. | 345/545 |
| 2009/0219264 | A1 * | 9/2009 | Erol et al. | 345/204 |
| 2010/0026930 | A1 * | 2/2010 | Jepsen | 349/62 |
| 2011/0285754 | A1 | 11/2011 | Harrington et al. | |

FOREIGN PATENT DOCUMENTS

| | | | |
|---|---|---|---|
| CN | 1589462 | | 3/2005 |
| JP | 02-136915 | A | 5/1990 |
| JP | 2003-256134 | A | 9/2003 |
| JP | 2006-243364 | A | 9/2006 |
| JP | 2006243364 | | 9/2006 |
| JP | 2007-102042 | A | 4/2007 |
| JP | 2007-241405 | A | 9/2007 |
| TW | 200504442 | | 2/2005 |
| WO | WO 03/044765 | A2 | 5/2003 |
| WO | WO 2004/034366 | A1 | 4/2004 |
| WO | 2005006296 | | 1/2005 |
| WO | WO 2005/027087 | A1 | 3/2005 |
| WO | 2005055187 | | 6/2005 |
| WO | WO 2005/073949 | | 8/2005 |
| WO | WO 2005/078692 | A1 | 8/2005 |
| WO | WO 2005/086131 | A1 | 9/2005 |
| WO | 2005101362 | | 10/2005 |
| WO | WO 2005/093705 | A1 | 10/2005 |
| WO | WO 2005/096259 | A1 | 10/2005 |
| WO | WO 2005/101362 | A1 | 10/2005 |
| WO | WO 2006/013502 | A1 | 2/2006 |
| WO | 2006090315 | | 8/2006 |
| WO | WO 2007/099829 | A1 | 9/2007 |
| WO | WO 2007/135594 | | 11/2007 |

OTHER PUBLICATIONS

Robert Zehner et al., *Drive Waveforms for Active Matrix Electrophoretic Displays*, May 2003, pp. 842-845, vol. XXXIV, Book II.

PCT International Search Report and Written Opinion, PCT/JP2008/061277, Aug. 19, 2008, 11 pages.

PCT International Search Report and Written Opinion, PCT/JP2008/061273, Sep. 16, 2008, 11 pages.

PCT International Search Report and Written Opinion, PCT/JP2008/061272, Sep. 30, 2008, 10 pages.

PCT International Search Report and Written Opinion, PCT/JP2008/061271, Sep. 30, 2008, 11 pages.

PCT International Search Report and Written Opinion, PCT/JP2008/061278, Oct. 7, 2008, 11 pages.

Crowley, J.M. et al., *Dipole Moments of Gyricon Balls*, Electrostatics Fundamentals. Applications and Hazards, Selected Papers from the Fourth IEJ-ESA Joint Symposium on Electrostatics, Sep. 25-26, 2000, pp. 247-259, vol. 55, No. 3-4.

Whitesides et al., "10.2: Towards Video-rate Microencapsulated Dual-Particle Electrophoretic Displays", 2004 SID International Symposium, Seattle, WA, May 25-27, 2004; [SID International Symposium], San Jose, CA, SID, US, vol. XXXV, May 25, 2004, pp. 133-135.

Johnson et al., "56.1: Invited Paper: High Quality Images on Electronic Paper Displays", 2005 SID International Symposium, Boston, MA, May 24-27, 2005 [SID International Symposium], San Jose, CA, SID, US, vol. XXXVI, May 24, 2005, pp. 1666-1669.

Extended European Search Report, Application No. 08765766.4, Feb. 9, 2011, 6 pages.

Extended European Search Report, Application 08765765.6, Mar. 10, 2011, 10 pages.

Extended European Search Report, Application No. 08777421.2, Apr. 15, 2011, 9 pages.
U.S. Office Action, U.S. Appl. No. 12/059,118, Apr. 20, 2011, 28 pages.
Chinese Office Action, Chinese Patent Application No. 200880000556.3, Apr. 8, 2011, 9 pages.
U.S. Office Action, U.S. Appl. No. 12/059,441, Apr. 20, 2011, 11 pages.
U.S. Office Action, U.S. Appl. No. 12/059,399, May 2, 2011, 29 pages.
U.S. Office Action, U.S. Appl. No. 12/059,085, May 13, 2011, 13 pages.
United States Office Action, U.S. Appl. No. 12/059,441, Aug. 12, 2011, 12 pages.
Extended European Search Report, European Patent Application No. EP08777423, Jun. 7, 2011, 12 pages.
Chinese Office Action, Chinese Application No. 200880000725.3, Jun. 29, 2011, 9 pages.
Japanese Office Action, Japanese Patent Application No. 2009-506841, Dec. 6, 2011, 2 pages.
U.S. Office Action, U.S. Appl. No. 12/415,899, Nov. 8, 2011, 27 pages.
U.S. Office Action, U.S. Appl. No. 12/059,085, Nov. 14, 2011, 21 pages.
U.S. Office Action, U.S. Appl. No. 12/059,441, Dec. 2, 2011, 29 pages.
U.S. Office Action, U.S. Appl. No. 12/059,118, Jan. 11, 2012, 23 pages.
U.S. Office Action, U.S. Appl. No. 12/059,399, Jan. 20, 2012, 54 pages.
Chinese Office Action, Chinese Application No. 200880000556.3, Aug. 1, 2011, 10 pages.
United States Office Action, U.S. Appl. No. 12/059,118, Sep. 14, 2011, 54 pages.
United States Office Action, U.S. Appl. No. 12/059,399, Sep. 15, 2011, 44 pages.
U.S. Office Action, U.S. Appl. No. 12/059,441, Mar. 29, 2012, 22 pages.
U.S. Office Action, U.S. Appl. No. 12/415,899, Mar. 29, 2012, 32 pages.
U.S. Notice of Allowance, U.S. Appl. No. 12/059,118, Apr. 9, 2012, 19 pages.
U.S. Office Action, U.S. Appl. No. 12/059,399, May 3, 2012, 43 pages.
JP Office Action, JP Patent Application No. 097122474, Feb. 23, 2012, 10 pgs.
EPO Communication, EP Patent Application No. 08 765 765.6-2205, Apr. 25, 2012, 9 pages.

* cited by examiner

PEN TRACKING AND LOW LATENCY DISPLAY UPDATES ON ELECTRONIC PAPER DISPLAYS

CROSS REFERENCE TO RELATED APPLICATIONS

This application claims the benefit of U.S. Provisional Patent Application No. 60/944,415, filed Jun. 15, 2007, entitled "Systems and Methods for Improving the Display Characteristics of Electronic Paper Displays," the contents of which are hereby incorporated by reference in its entirety.

BACKGROUND

1. Field of Art

The disclosure generally relates to the field of electronic paper displays. More particularly, the invention relates to pen tracking and low latency display updates on electronic paper displays.

2. Description of the Related Art

Several technologies have been introduced recently that provide some of the properties of paper in a display that can be updated electronically. Some of the desirable properties of paper that this type of display tries to achieve include: low power consumption, flexibility, wide viewing angle, low cost, light weight, high resolution, high contrast, and readability indoors and outdoors. Because these displays attempt to mimic the characteristics of paper, these displays are referred to as electronic paper displays (EPDs) in this application. Other names for this type of display include: paper-like displays, zero power displays, e-paper, bi-stable and electrophoretic displays.

A comparison of EPDs to Cathode Ray Tube (CRT) displays or Liquid Crystal Displays (LCDs) reveal that in general, EPDs require less power and have higher spatial resolution; but have the disadvantages of slower update rates, less accurate gray level control, and lower color resolution. Many electronic paper displays are currently only grayscale devices. Color devices are becoming available although often through the addition of a color filter, which tends to reduce the spatial resolution and the contrast.

Electronic Paper Displays are typically reflective rather than transmissive. Thus they are able to use ambient light rather than requiring a lighting source in the device. This allows EPDs to maintain an image without using power. They are sometimes referred to as "bi-stable" because black or white pixels can be displayed continuously and power is only needed to change from one state to another. However, some devices are stable at multiple states and thus support multiple gray levels without power consumption.

While electronic paper displays have many benefits, a problem is that most EPD technologies require a relatively long time to update the image as compared with conventional CRT or LCD displays. A typical LCD takes approximately 5 milliseconds to change to the correct value, supporting frame rates of up to 200 frames per second (the achievable frame rate is typically limited by the ability of the display driver electronics to modify all the pixels in the display). In contrast, many electronic paper displays, e.g. the E Ink displays, take on the order of 300-1000 milliseconds to change a pixel value from white to black. While this update time is generally sufficient for the page turning needed by electronic books, it is problematic for interactive applications like pen tracking, user interfaces, and the display of video.

One type of EPD called a microencapsulated electrophoretic (MEP) display moves hundreds of particles through a viscous fluid to update a single pixel. The viscous fluid limits the movement of the particles when no electric field is applied and gives the EPD its property of being able to retain an image without power. This fluid also restricts the particle movement when an electric field is applied and causes the display to be very slow to update compared to other types of displays.

When displaying a video or animation, each pixel should ideally be at the desired reflectance for the duration of the video frame, i.e. until the next requested reflectance is received. However, every display exhibits some latency between the request for a particular reflectance and the time when that reflectance is achieved. If a video is running at 10 frames per second and the time required to change a pixel is 10 milliseconds, the pixel will display the correct reflectance for 90 milliseconds and the effect will be as desired. If it takes 100 milliseconds to change the pixel, it will be time to change the pixel to another reflectance just as the pixel achieves the correct reflectance of the prior frame. Finally, if it takes 200 milliseconds for the pixel to change, the pixel will never have the correct reflectance except in the circumstance where the pixel was very near the correct reflectance already, i.e. slowly changing imagery.

In some electronic paper displays, annotation is possible by adding an input sensor layer on top of or underneath the display. These types of electronic paper displays work like a writing tablet. A pen or a stylus is used to activate the pixels on writing surface of the electronic paper display, thus acting like a pen or pencil writing or making annotations on a piece of paper. However, because of the limited speed at which the image can be updated, the EPDs are not effective at showing pen tracking in real time. The key requirements of pen tracking are update speed and contrast, which generally conflict with each other on electronic paper displays. For instance, drawing a light gray line takes shorter time than drawing a black line on some EPDs.

It would therefore be highly desirable to enable both high speed and high contrast on current electronic paper displays, thus allowing for real-time pen tracking.

SUMMARY

The present invention overcomes the deficiencies and limitation of the prior art by providing a system and method for fast pen tracking and low latency display updates on an electronic paper display.

Pen input information is received on an electronic paper display that updates at a predetermined display update rate. A line drawing module of the electronic paper display driver determines at least one pixel to activate based on the received pen input information. The at least one pixel is updated independent of the display update rate of the electronic paper display. Active pixel state information is maintained separately for each pixel in real time until the pixel update is complete and the pixel is deactivated. In some embodiments, a future pixel to activate is determined based on the received pen input information. The future pixel is deactivated if pen input information is not received on the activated pixel for a predetermined amount of time.

The features and advantages described in the specification are not all inclusive and, in particular, many additional features and advantages will be apparent to one of ordinary skill in the art in view of the drawings, specification and claims. Moreover, it should be noted that the language used in the specification has been principally selected for readability and instructional purposes and may not have been selected to delineate or circumscribe the disclosed subject matter.

BRIEF DESCRIPTION OF DRAWINGS

The disclosed embodiments have other advantages and features which will be more readily apparent from the detailed description, the appended claims and the accompanying figures (or drawings). A brief introduction of the figures is below.

FIG. (FIG.) 1 illustrates a cross-sectional view of a portion of an exemplary electronic paper display in accordance with some embodiments.

Figure 1:
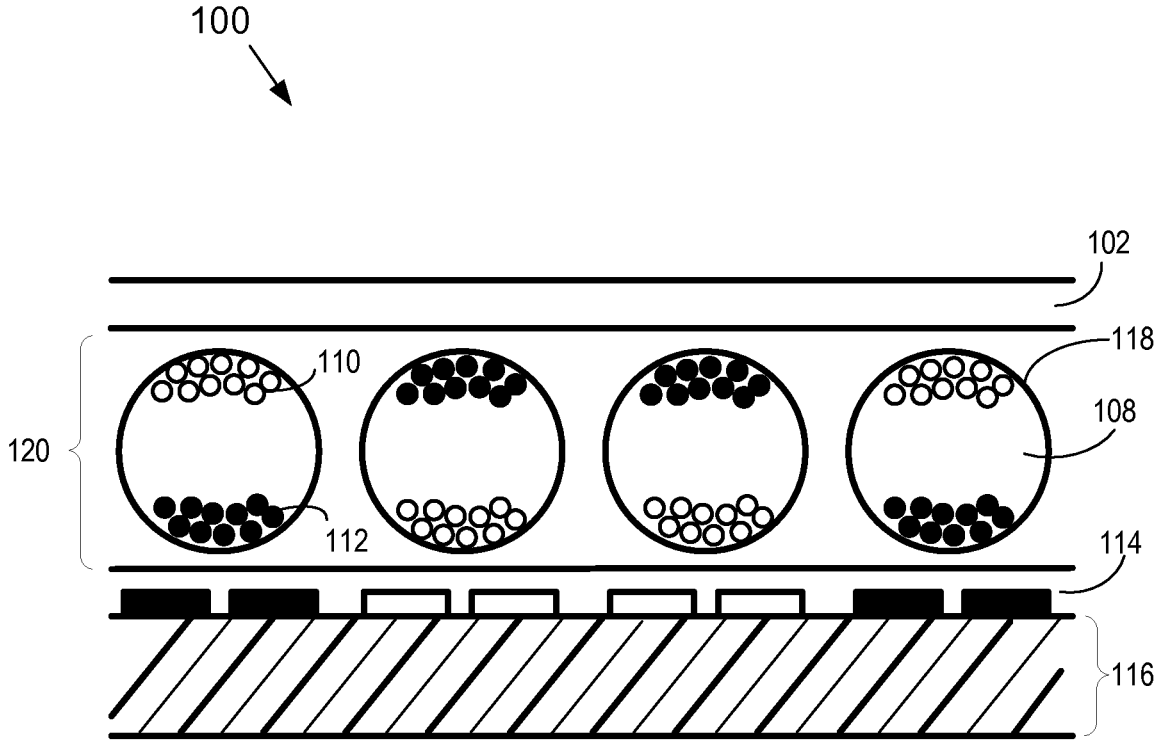

The figures depict various embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION

The Figures (FIGS.) and the following description relate to preferred embodiments by way of illustration only. It should be noted that from the following discussion, alternative embodiments of the structures and methods disclosed herein will be readily recognized as viable alternatives that may be employed without departing from the principles of what is claimed.

As used herein any reference to "one embodiment," "an embodiment," or "some embodiments" means that a particular element, feature, structure or characteristic described in connection with the embodiment is included in at least one embodiment. The appearances of the phrase "in one embodiment" in various places in the specification are not necessarily all referring to the same embodiment.

Some embodiments may be described using the expression "coupled" and "connected" along with their derivatives. It should be understood that these terms are not intended as synonyms for each other. For example, some embodiments may be described using the term "connected" to indicate that two or more elements are in direct physical or electrical contact with each other. In another example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments are not limited in this context.

As used herein, the terms "comprises," "comprising," "includes," "including," "has," "having" or any other variation thereof, are intended to cover a non-exclusive inclusion. For example, a process, method, article or apparatus that comprises a list of elements is not necessarily limited to only those elements but may include other elements not expressly listed or inherent to such process, method, article or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present) and both A and B are true (or present).

In addition, use of the "a" or "an" are employed to describe elements and components of the embodiments herein. This is done merely for convenience and to give a general sense of the invention. This description should be read to include one or at least one and the singular also includes the plural unless it is obvious that it is meant otherwise.

Reference will now be made in detail to several embodiments, examples of which are illustrated in the accompanying figures. It is noted that wherever practicable similar or like reference numbers may be used in the figures and may indicate similar or like functionality. The figures depict embodiments of the disclosed system (or method) for purposes of illustration only. One skilled in the art will readily recognize from the following description that alternative embodiments of the structures and methods illustrated herein may be employed without departing from the principles described herein.

Device Overview

FIG. (FIG.) 1 illustrates a cross-sectional view of a portion of an exemplary electronic paper display 100 in accordance with some embodiments. The components of the electronic paper display 100 are sandwiched between a top transparent electrode 102 and a bottom backplane 116. The top transparent electrode 102 is a thin layer of transparent material. The top transparent electrode 102 allows for viewing of microcapsules 118 of the electronic paper display 100.

Directly beneath the transparent electrode 102 is the microcapsule layer 120. In one embodiment, the microcapsule layer 120 includes closely packed microcapsules 118 having a clear liquid 108 and some black particles 112 and white particles 110. In some embodiments, the microcapsule 118 includes positively charged white particles 110 and negatively charged black particles 112. In other embodiments, the microcapsule 118 includes positively charged black particles 112 and negatively charged white particles 110. In yet other embodiments, the microcapsule 118 may include colored particles of one polarity and different colored particles of the opposite polarity. In some embodiments, the top transparent electrode 102 includes a transparent conductive material such as indium tin oxide.

Disposed below the microcapsule layer 120 is a lower electrode layer 114. The lower electrode layer 114 is a network of electrodes used to drive the microcapsules 118 to a desired optical state. The network of electrodes is connected to display circuitry, which turns the electronic paper display "on" and "off" at specific pixels by applying a voltage to specific electrodes. Applying a negative charge to the electrode repels the negatively charged particles 112 to the top of microcapsule 118, forcing the positively charged white particles 110 to the bottom and giving the pixel a black appearance. Reversing the voltage has the opposite effect—the positively charged white particles 112 are forced to the surface, giving the pixel a white appearance. The reflectance (brightness) of a pixel in an EPD changes as voltage is applied. The amount the pixel's reflectance changes may depend on both the amount of voltage and the length of time for which it is applied, with zero voltage leaving the pixel's reflectance unchanged.

The electrophoretic microcapsules of the layer 120 may be individually activated to a desired optical state, such as black, white or gray. In some embodiments, the desired optical state may be any other prescribed color. Each pixel in layer 114 may be associated with one or more microcapsules 118 contained with a microcapsule layer 120. Each microcapsule 118 includes a plurality of tiny particles 110 and 112 that are suspended in a clear liquid 108. In some embodiments, the plurality of tiny particles 110 and 112 are suspended in a clear liquid polymer.

The lower electrode layer 114 is disposed on top of a backplane 116. In one embodiment, the electrode layer 114 is integral with the backplane layer 116. The backplane 116 is a plastic or ceramic backing layer. In other embodiments, the backplane 116 is a metal or glass backing layer. The electrode layer 114 includes an array of addressable pixel electrodes and supporting electronics.

System Overview

Figure 2:
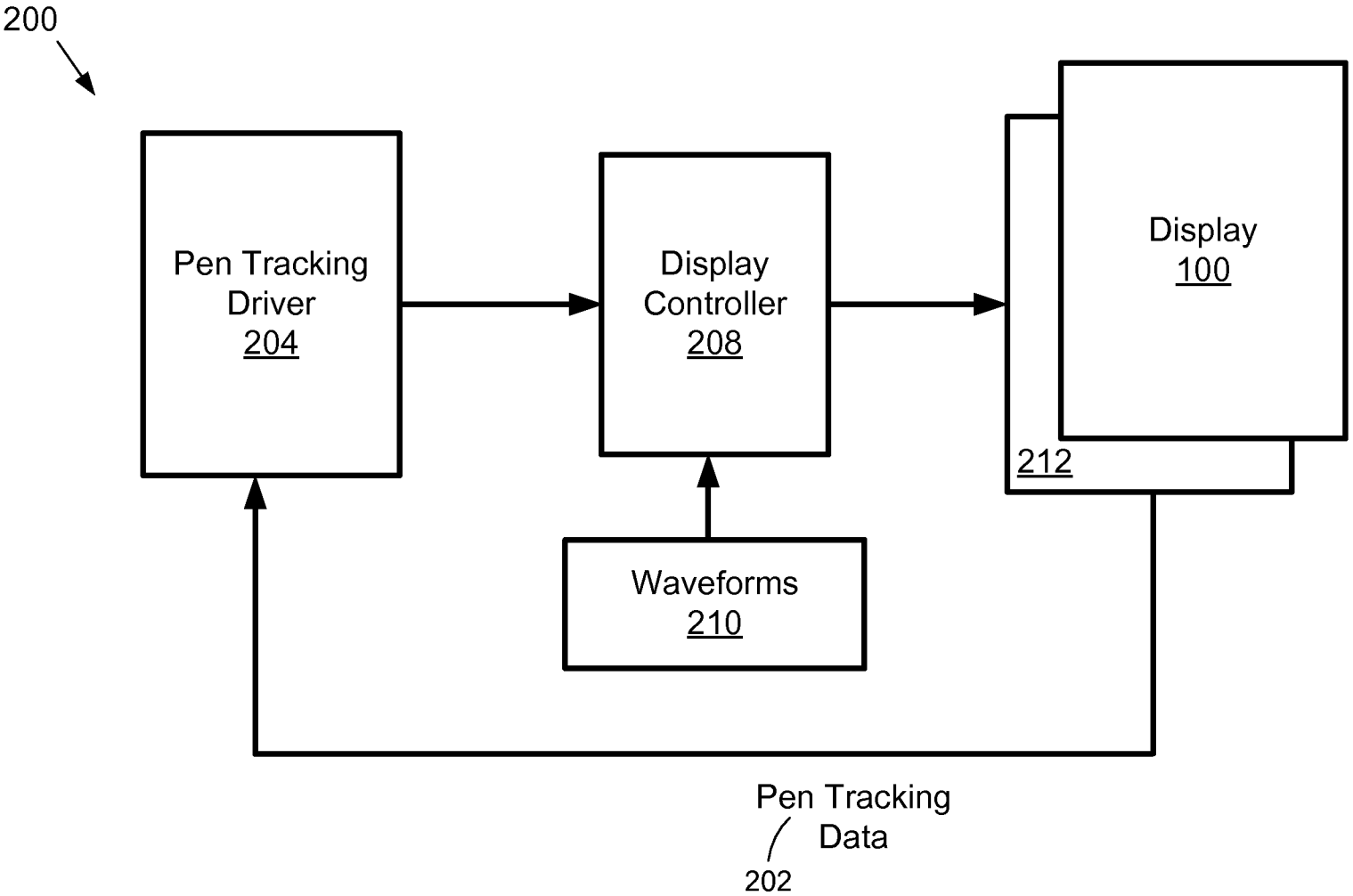
FIG. 2 illustrates a block diagram of a control system of the electronic paper display in accordance with some embodiments.

FIG. 2 illustrates a block diagram of a control system 200 of the electronic paper display 100 in accordance with some embodiments. The system includes the electronic paper display 100, an input sensor panel 212, a pen tracking driver 204, a display controller 208 and a waveforms module 210. In some embodiments, the display 100 includes the input sensor panel 212. In some embodiments, the input sensor panel 212 is a touch screen sensor disposed on top of the display 100. In other embodiments, the input sensor panel 212 is disposed beneath the display 100 like a Wacom EMR sensor.

For purposes of illustration, FIG. 2 shows the pen tracking driver 204 and display controller 208 as discrete modules. However, in various embodiments, any or all of the pen tracking driver 204 and display controller 208 can be combined. This allows a single module to perform the functions of one or more of the above-described modules.

The pen tracking driver 204 receives pen tracking data 202 as a pen or stylus comes in contact with input sensor panel 212. The pen tracking driver 204 keeps track of the active pixels and maintains a frame counter for each pixel. More information regarding the functionality of the pen tracking driver 204 is provided below in the description of FIGS. 3-5.

An active pixel buffer (not shown in this figure) receives information and stores controlling information. The active pixel buffer contains the pixel data directly used by the display controller 208. More details regarding the active pixel buffer is provided below.

The display controller 208 includes a host interface for receiving information such as pixel data. The display controller 208 also includes a processing unit, a data storage database, a power supply and a driver interface (not shown). In some embodiments, the display controller 208 includes a temperature sensor and a temperature conversion module. In some embodiments, a suitable controller used in some electronic paper displays is one manufactured by E Ink Corporation. For example, a suitable controller is the METRONOME™ display controller manufactured by E Ink Corporation.

The waveforms module 210 stores the waveforms to be used during pen tracking on the electronic paper display. In some embodiments, each waveform includes 256 frames, in which each frame takes a twenty millisecond (ms) time slice and the voltage amplitude is constant for all frames. The voltage amplitude is either 15 volts (V), 0V, or −15V. In some embodiments, 256 frames is the maximum number of frames that can be stored in the active pixel buffer 304 (FIG. 3) for a particular display controller. In some embodiments, the maximum number of frames is used to minimize the possible overhead of time gaps between repeatedly called display commands during a long stroke pen tracking.

During display updates, the three waveforms are indexed by the controller as follows. In some embodiments, each pixel has 8 bits; 4 bits being the pixel value of the current state and the other 4 bits being the pixel value of the next state. In some embodiments, only two values are used for each state of each pixel: 0x0 and 0xF in hexadecimal, representing the black state and white state, respectively. Provided below is list of the waveform index pairs of current and next pixel state values in hexadecimal, and the corresponding impulse voltage, and the represented state transition:

current=0x0, next=0xF, 15V, black to white;
current=0xF, next=0x0, −15V, white to black;
current=0x0, next=0x0, 0V, no change in pixel color; and
current=0xF, next=0xF, 0V, no change in pixel color.

When a white pixel is activated by the pen tracking, its next state in the frame buffer becomes black. Therefore, the waveform of −15V is applied on the pixel. On the other hand, if a pixel is not activated, then the 0V is applied on the pixel. The duration of the voltage addressing is determined by a frame counter for that pixel, a description of which is provided below.

Figure 3:
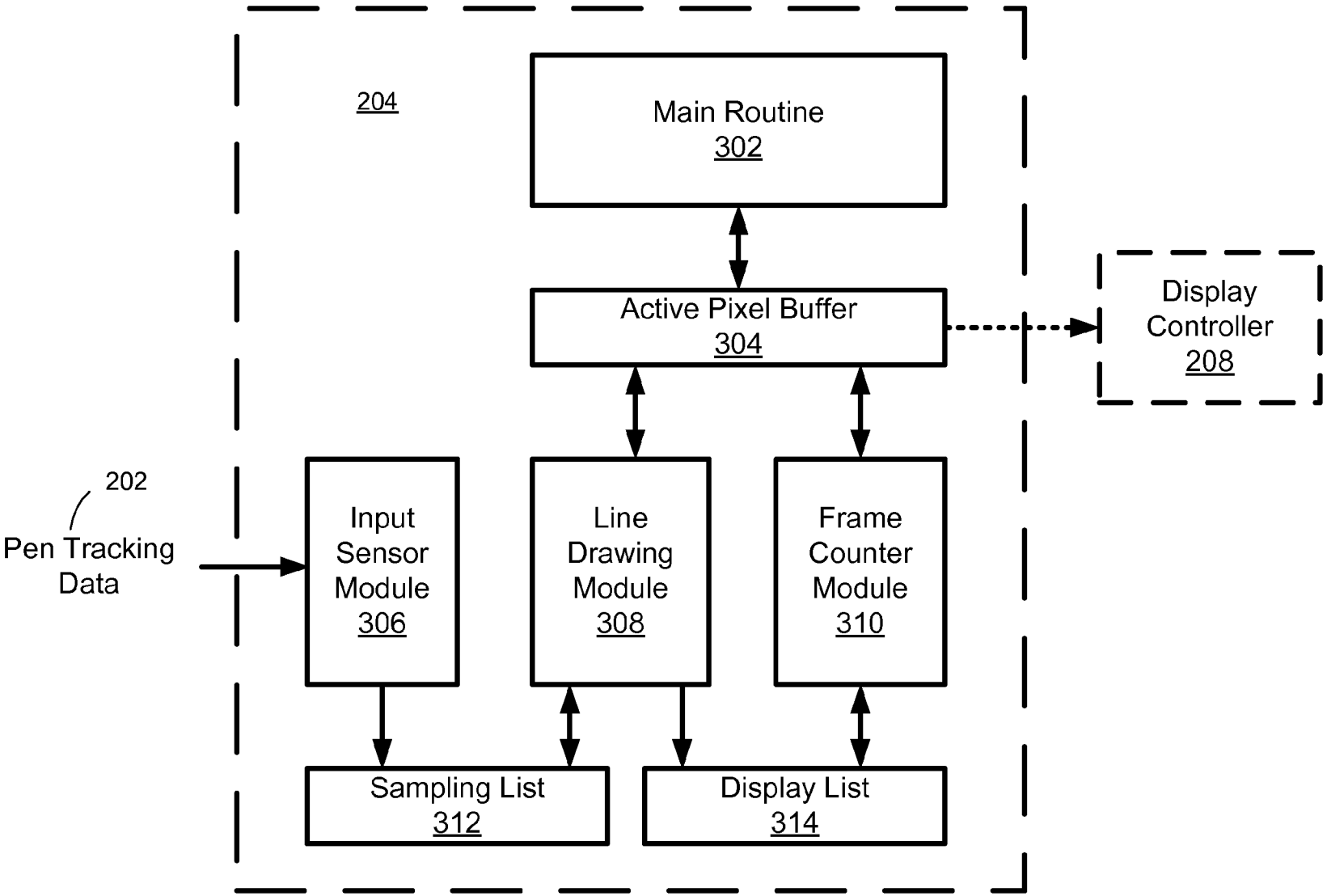
FIG. 3 illustrates software architecture of a pen tracking driver in the electronic paper display system in accordance with some embodiments.

FIG. 3 illustrates software architecture of a pen tracking driver 204 in the control system 200 in accordance with some embodiments. The software architecture includes a main routine 302, an active pixel buffer 304, three modules 306, 308 and 310 and two data buffers 312 and 314.

The three modules include an input sensor module 306, a line drawing module 308 and frame counter module 310. These modules are three threads that perform in parallel. The threads utilize two major data buffers: a sampling list 312 and a display list 314. The sampling list 312 stores the screen touched points that are sampled by the input sensor and that have not been processed by the line drawing module 308. The display list 314 keeps track of the active pixels that are being updated (blackened) by a display controller 208. The display list 314 also maintains a frame counter for each pixel, which determines the duration of voltage addressing for each pixel.

The input sensor module 306 monitors the input sensor sample data buffer received from the input sensor panel 212 and adds new samples to the sample list. The input sensor module 306 receives pen tracking data 202 as the input sensor panel 212 of the electronic paper display 100 is touched. In some embodiments, the input sensor module 306 receives the pen tracking data 202 in the form of coordinates of the points touched on the input sensor. In some embodiments, the input sensor module 306 receives the pen tracking data 202 and converts the data into another readable form. The input sensor module 306 adds the pen tracking data 202 to the sampling list as the pen tracking data 202 is received.

The line drawing module 308 reads the pen tracking data 202 from the sampling list 312. The line drawing module 308 uses the pen tracking data 202 to draw a line or curve between neighboring sample points. In some embodiments, Bresenham's line drawing algorithm is used to draw a line between each two neighboring sample points. Algorithms for drawing lines between two points are well understood by those skilled in the art of computer graphics and will not be described in more detail here.

During the line drawing process, each activated pixel is immediately updated in the active pixel buffer 304, where, for example, a current state value of white (0xF) and a next state value of black (0) are written. The line drawing module 308 initiates the display update of the pixel by setting up that state of the pixel in the active pixel buffer 304, therefore updating the information of the pixel with the desired state information. The line drawing module 308 sends information associated with which pixels are to be updated. The active pixel buffer 304 stores this information, which includes information associated with the direction that the image should be going. In other words, the active pixel buffer 304 stores information to help determine which pixel to activate to allow for pixel by pixel update based, in part, on the data received from the line drawing module 308.

During the line drawing, each drawn pixel is immediately updated in the active pixel buffer 304. Meanwhile, the line drawing module 308 also adds each pixel on the line to the display list 314 and sets the frame counter for the pixel using a predefined number. For example, in some embodiments, the line drawing module 308 also each pixel on the line to the display list 314 and sets the frame counter a value of fifteen frames. The processed sample data points are then removed from the sampling list 312.

The frame counter module 310 repeatedly scans the display list 314 and checks the frame counter for each pixel in the list. The frame counter module 310 relays information regarding the duration of the pixel update to the active pixel buffer 304. In other words, the frame counter module 310 keeps track of the frame counter for each pixel update. When the frame counter equals zero, this indicates that the pixel update is complete and needs to be reset in the active pixel buffer 304.

Figure 5:
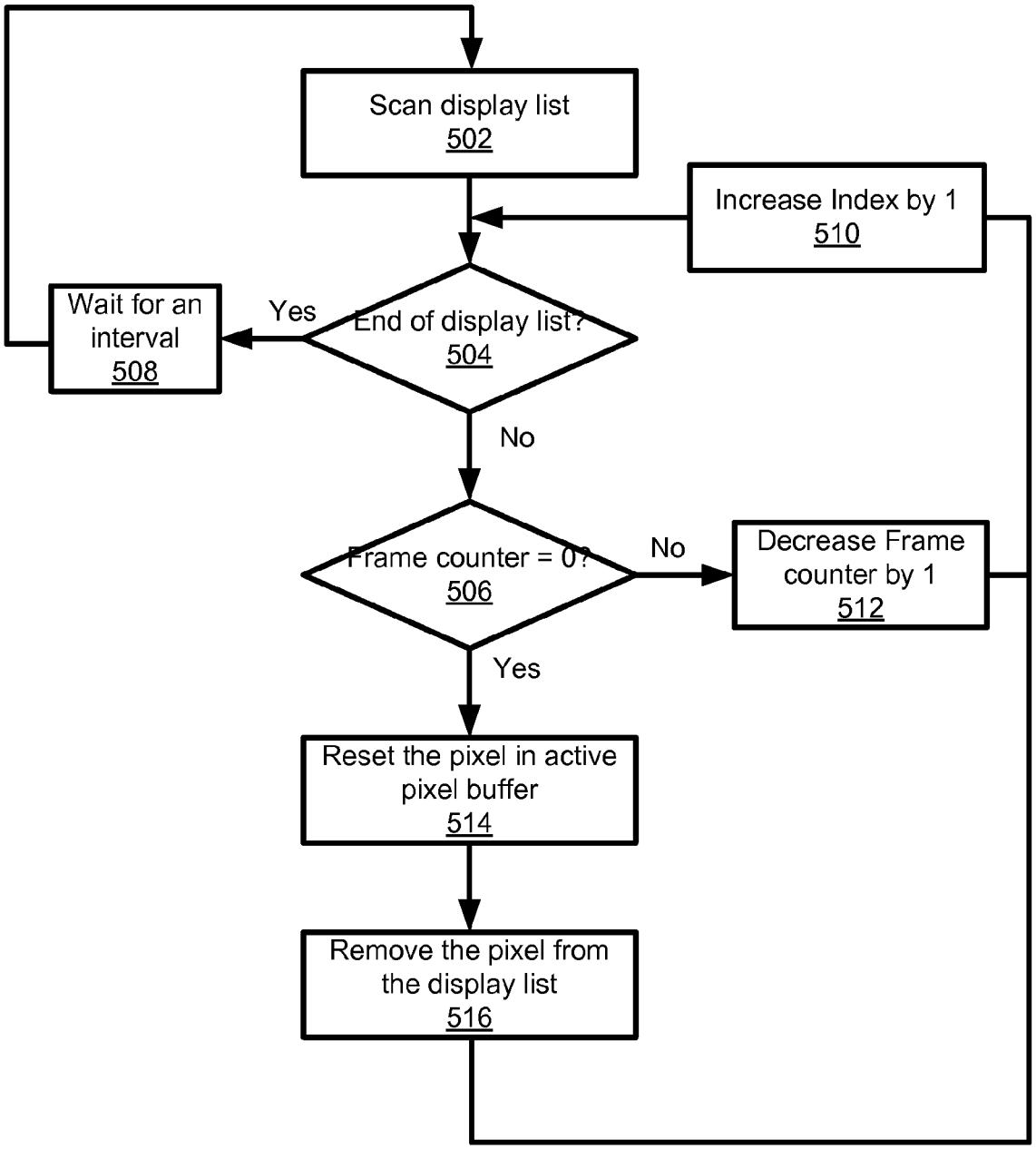
FIG. 5 illustrates a flow chart of the frame counter thread of the pen tracking driver in the electronic paper display system in accordance with some embodiments.

FIG. 5 illustrates a flow chart of the frame counter module 310 of the pen tracking driver 204 in the electronic paper display system in accordance with some embodiments. The frame counter module 310 scans 502 the display list 314 and checks the frame counter for each pixel in the display list 314. A determination 504 is made as to whether the scan has reached the end of the display list 314. If the end of the display list 314 has been reached (504—Yes), the frame counter module 310 waits for a predetermined interval of time and continues to scan 502 the display list 314. In some embodiments, the frame counter module 310 waits for 20 ms until it continues to scan the display list 314. This allows for the display update to execute for a portion of time after the frame counter is decreased.

If the end of the display list 314 has not been reached (504—No), a determination 506 is made as to whether the frame counter is equal to zero. If the frame counter is not equal to zero (506—No), the frame counter is decreased 512 by one. If the frame counter is equal to zero, this means that the pixel has completed its transition from one state to the next. The index is then increased 510 by one and frame counter module 310 continues to determine 504 whether it has reached the end of the display list.

If the frame counter is equal to zero (506—Yes), the pixel value in the active pixel buffer 304 is reset 514 since the pixel has completed its transition from one state to the next, for example, from white to black. As an example, a current pixel value of zero and a next pixel value of zero are written to the active pixel buffer 304. A voltage of zero is applied to the pixel update until the next change occurs. The deactivated pixel is removed 516 from the display list 314.

In some embodiments, the predefined interval of time and frame counter initial value can be selected to achieve the desired state of the pen tracking pixels, depending on the application requirements, typically the contrast and update speed. At a given time interval, the larger the frame counter initial values are, the longer the duration of update. However, when the frame counter initial value is large enough, the updated pixels end up as saturated black. If saturation is not desired, the frame counter initial value should be set small.

Figure 4:
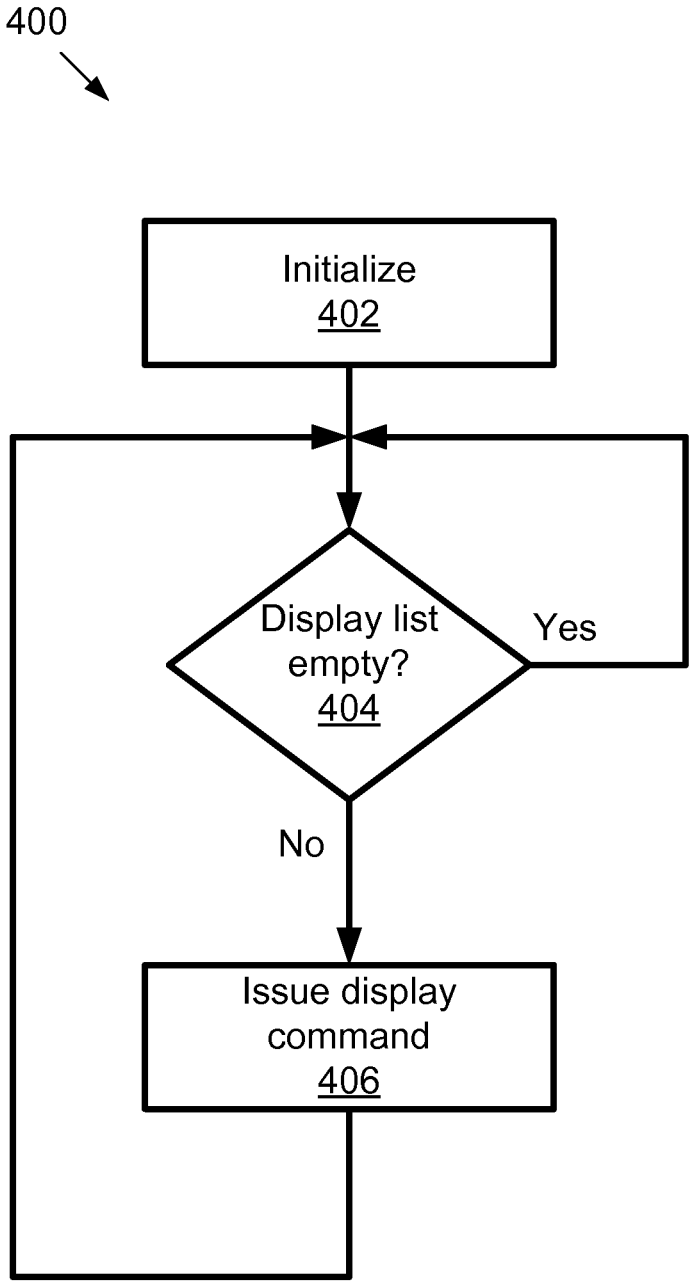
FIG. 4 illustrates a flow chart of the main routine of the pen tracking driver in the electronic paper display system in accordance with some embodiments.

Referring back to FIG. 3, the main routine 302 repeatedly checks the display list 314 and if the display list 314 is not empty, a display command is issued to the display controller 208. FIG. 4 illustrates a flow chart of the main routine 302 of the pen tracking driver 204 in the electronic paper display system in accordance with some embodiments. The main routine 302 repeatedly checks the display list 314 and if the display list 314 is not empty, a display command is issued to the display controller 208.

The main routine 302 is initialized 402 and determines 404 whether the display list 314 is empty. If the display list 314 is empty (404—Yes), it continues to check 315 the display list 314. If the display list 314 is not empty (404—No), a display command is issued 406 to the display controller 208. In other words, the main routine 302 keeps the display controller 208 active as the main routine 302 constantly provides information to the display controller 208 as the information is received.

Figure 6:
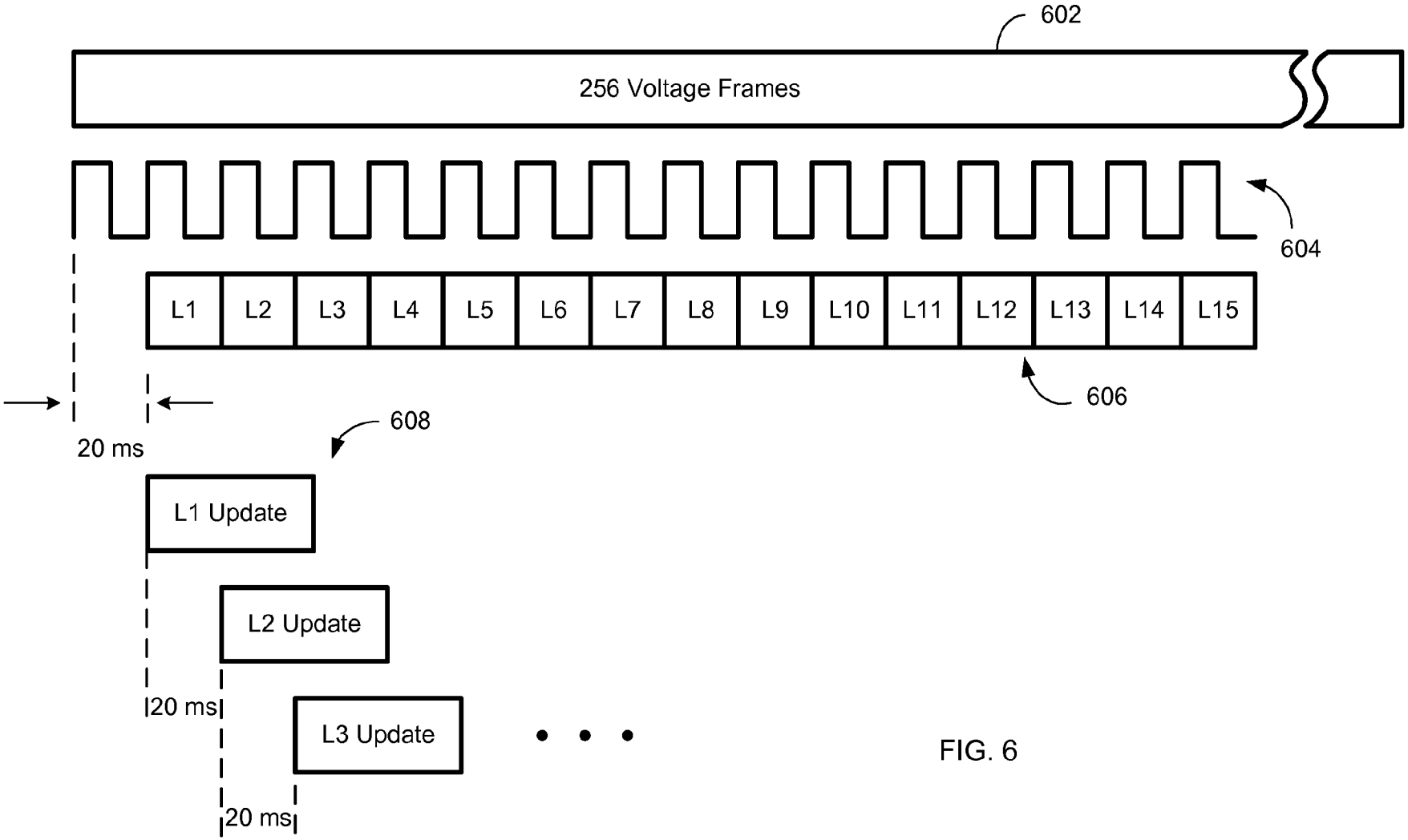
FIG. 6 shows a graphical representation of pen tracking timing of the electronic paper display system in accordance with some embodiments.

FIG. 6 illustrates a graphical representation of pen tracking timing of the electronic paper display 100 in accordance with some embodiments. In some embodiments, each waveform includes 256 frames and display updates 602 for the 256 voltage frames occur at an update rate of 20 ms. The input sensor sampling 604 is performed at a sampling rate of 20 ms. The line drawing and active pixel buffer updates 606 also occur at an update rate of 20 ms. In other words, as shown in the line pixel display updates 608, line pixel L1 update starts when initiated and line pixel L2 update occurs 20 ms after the initiation of line pixel L1 update. Line pixel L3 then occurs 20 ms after the initiation of line pixel L2 update, and so on. This pixel by pixel update allows for fast pen tracking on electronic paper displays. Pixels can be individually updated at a very high rate, independent of the entire display being updated.

In an alternate embodiment, motion prediction can be used to determine future pixels to be updated to achieve both high contrast and fast pen tracking update. Each of these future pixels can be activated for updating several frames earlier than the time when it is actually touched by the pen. Later on, if an activated pixel is not actually touched by the pen, the pixel updating is then immediately turned off, or deactivated. This idea is based on the fact that the reflectance time response of some electronic paper displays has highly non-linear characteristics.

The non-linearity of the reflectance-time response indicated that the display brightness change gets smaller when the gray state is saturated in either direction, black or white. This implies that earlier start of update would not be noticeable by the human eye until a certain time period later. Therefore, motion prediction could be used to save some time for the entire state transition. The more non-linear near the saturation zone, the more time could be saved by using motion prediction.

The motion prediction can be performed during the line drawing process. The line drawing algorithm predicts the pen moving direction for the next few steps and activates the display update for the pixels in a certain shape of region that lies in the predicted moving direction. The prediction can be either line or curvature based, depending on the specific application.

Figure 7:
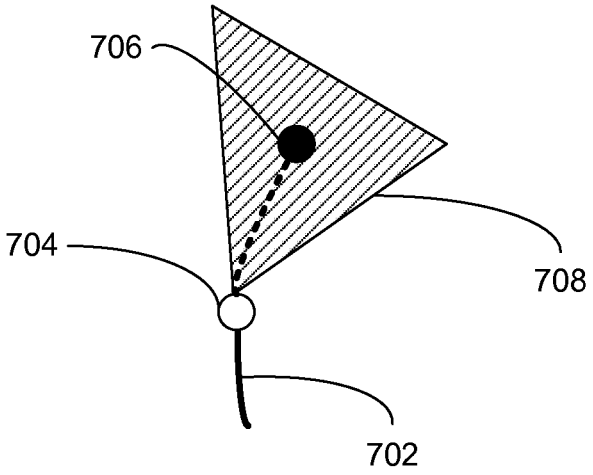
FIG. 7 illustrates a graphical representation of a method for motion prediction in accordance with some embodiments.

FIG. 7 illustrates a graphical representation of a method for motion prediction in accordance with some embodiments. As shown in FIG. 7, line 702 represents a line drawn on an electronic paper display. In FIG. 7 line 702 is at current point 704, which is where the input sensor is touching the display. As the pen tracking moves toward the future point 706, the pixels within the region 708 are activated for a predetermined period of time. For example, in some embodiments, the pixels within the region 708 are activated for 60 ms. If the pixel is not actually activated (not actually touched by the pen tracking movement) after the predetermined period of time, the pixel is deactivated or turned off. The rate at which this occurs allows for the appearance of fast pen tracking when pen tracking is being performed on an electronic paper display. Deactivating a pixel means restoring it to the original state by driving it in reverse using the opposite voltage for the same amount of time it was originally driven when it was activated.

Upon reading this disclosure, those of skill in the art will appreciate still additional alternative structural and functional designs for a system and a process for pen tracking and low latency updates on an electronic paper display through the disclosed principles herein. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the method and apparatus disclosed herein without departing from the spirit and scope defined in the appended claims.

What is claimed is:

1. A method for activating pixels on an electronic paper display that updates at a predetermined display update rate, comprising:

receiving pen input information for at least one current pixel of the electronic paper display;

determining the at least one current pixel to activate based on the pen input information for the at least one current pixel;

activating the at least one current pixel of the electronic paper display independent of the display update rate of the electronic paper display;

predicting a direction of the pen input to determine at least one future pixel of the electronic paper display to activate based on the pen input information for the at least one current pixel;

activating the at least one future pixel based on the pen input information for the at least one current pixel; and deactivating the activated future pixel after a predetermined amount of time in response to an absence of receiving pen input information for the activated future pixel.

2. The method of claim 1, further comprises activating the at least one future pixel by applying a voltage to the at least one future pixel.

3. The method of claim 2, further comprises deactivating the activated future pixel by reversing the applied voltage to the activated future pixel.

4. The method of claim 1, further comprising:

activating a region of the electronic paper display based on the pen input information for the at least one current pixel; and deactivating the activated region of the electronic paper display in response to, after the predetermined amount of time, an absence of receiving pen input information for the activated region.

5. The method of claim 1, wherein the pen input information is received on a touch sensor display.

6. The method of claim 1, further comprising:

maintaining active pixel information for each current pixel.

7. The method of claim 6, wherein the maintaining active pixel information includes maintaining a display list for each current pixel.

8. The method of claim 6, wherein the maintaining active pixel information includes maintaining a frame counter for each current pixel.

9. A system for activating pixels on an electronic paper display that updates at a predetermined display update rate, comprising:

means for receiving pen input information for at least one current pixel of the electronic paper display;

means for determining the at least one current pixel to activate based on the pen input information for the at least one current pixel;

means for activating the at least one current pixel of the electronic paper display independent of the display update rate of the electronic paper display;

means for predicting a direction of the pen input to determine at least one future pixel of the electronic paper display to activate based on the pen input information for the at least one current pixel;

means for activating the at least one future pixel based on the pen input information for the at least one current pixel; and means for deactivating the activated future pixel after a predetermined amount of time in response to an absence of receiving pen input information for the activated future pixel.

10. The system of claim 9, further comprising:

means for activating the at least one future pixel by applying a voltage to the at least one future pixel.

11. The system of claim 10, further comprising:

means for deactivating the activated future pixel by reversing the applied voltage to the activated future pixel.

12. The system of claim 9, further comprising:

means for activating a region of the electronic paper display based on the pen input information for the at least one current pixel; and means for deactivating the activated region of the electronic paper display in response to, after the predetermined amount of time, an absence of receiving pen input information for the activated region.

13. The system of claim 9, wherein the pen input information is received on a touch sensor display.

14. The system of claim 9, further comprising:

means for maintaining active pixel information for each current pixel.

15. The system of claim 14, wherein the means for maintaining active pixel information includes maintaining a display list for each current pixel.

16. The system of claim 14, wherein the means for maintaining active pixel information includes maintaining a frame counter for each current pixel.

17. An apparatus for pen tracking on an electronic paper display that updates at a predetermined display update rate, comprising:

one or more processors;

an input sensor module for receiving pen input information for at least one current pixel of the electronic paper display; and a line drawing module stored on a memory and executable by the one or more processors, the line drawing module coupled to the input sensor module and for determining the at least one current pixel to activate based on the pen input information for the at least one current pixel, predicting a direction of the pen input to determine at least one future pixel of the electronic paper display to activate based on the pen input information for the at least one current pixel and for activating the at least one current pixel of the electronic paper display independent of the display update rate of the electronic paper display;

a third module stored on the memory and executable by the one or more processors, the third module coupled to the line drawing module for activating the at least one future pixel based on the pen input information for the at least one current pixel; and a fourth module stored on the memory and executable by the one or more processors, the fourth module coupled to the line drawing module for deactivating the activated future pixel after a predetermined amount of time in response to an absence of receiving pen input information for the activated future pixel.

18. The apparatus of claim 17, wherein the third module activates the at least one future pixel by applying a voltage to the at least one future pixel.

19. The apparatus of claim 18, wherein the fourth module deactivates the activated future pixel by reversing the applied voltage to the activated future pixel.

20. The apparatus of claim 17, wherein the third module further activates a region of the electronic paper display based on the pen input information for the at least one current pixel and the fourth module further deactivates the activated region of the electronic paper display in response to, after the predetermined amount of time, an absence of receiving pen input information for the activated region.

21. The apparatus of claim 17, wherein the pen input information is received on a touch sensor display.

22. The apparatus of claim 17, further comprising:

an active pixel buffer for maintaining active pixel information for each current pixel.

23. The apparatus of claim 22, wherein the active pixel buffer for maintaining active pixel information includes maintaining a display list for each current pixel.

24. The apparatus of claim 22, wherein the active pixel buffer for maintaining active pixel information includes maintaining a frame counter for each current pixel.

* * * * *